United States Patent [19]

Taylor et al.

[11] Patent Number: 4,908,066

[45] Date of Patent: Mar. 13, 1990

[54] NO SPILL HIGH CHAIR TRAY/BOWL

[75] Inventors: Therese A. Taylor, 4601 N. 102nd Ave., No. 1049, Phoenix, Ariz. 85039; George Spector, New York, N.Y.

[73] Assignee: Therese A. Taylor, Phoenix, Ariz. ; a part interest

[21] Appl. No.: 311,033

[22] Filed: Feb. 15, 1989

[51] Int. Cl.[4] ..... A47B 85/00

[52] U.S. Cl. ..... 108/26; 297/188; 248/154; 248/506

[58] Field of Search ..... 297/188, 154; 108/26, 108/26.2; 248/154, 506

[56] References Cited

U.S. PATENT DOCUMENTS

| | | | |
|---|---|---|---|
| 1,060,782 | 5/1913 | Newby | 108/26.2 |
| 1,377,588 | 5/1921 | Kayser | 108/26.2 |
| 1,587,874 | 6/1926 | Strickland | 248/154 X |
| 2,601,279 | 6/1952 | Hacus | 248/154 X |
| 2,684,110 | 7/1954 | Stone | 297/154 |
| 2,850,079 | 9/1958 | Prushnok et al. | 248/586 |
| 3,635,522 | 1/1972 | Kerwit | 297/153 |
| 3,679,161 | 7/1972 | Husting | 248/154 |
| 4,040,549 | 8/1977 | Sadler | 248/154 |
| 4,548,440 | 10/1985 | Meslin et al. | 108/26 |

FOREIGN PATENT DOCUMENTS

| | | | |
|---|---|---|---|
| 51895 | 7/1936 | Denmark | 248/506 |

*Primary Examiner*—Francis K. Zugel
*Attorney, Agent, or Firm*—Harry M. Weiss

[57] ABSTRACT

An improved feeding tray for a high chair is provided with a bowl attached thereto which prevents the bowl from spilling and slipping off the tray during meal time. The bowl is adapted to be quickly detached from the tray so that it can be properly cleaned after meal time.

2 Claims, 1 Drawing Sheet

NO SPILL HIGH CHAIR TRAY/BOWL

BACKGROUND OF THE INVENTION

The instant invention relates generally to high chair attachments and more specifically it relates to an improved feeding tray for a high chair.

Numerous high chair attachments have been provided in prior art that are adapted to include feeding trays that are attachable thereto which prevent children from overturning food. For example, U.S. Pat. Nos. 2,684,100; 3,143,374 and 4,606,576 all are illustrative of such prior art. While these units may be suitable for the particular purpose to which they address, they would not be as suitable for the purposes of the present invention as heretofore described.

SUMMARY OF THE INVENTION

A primary object of the present invention is to provide an improved feeding tray for a high chair that will overcome the shortcomings of the prior art devices.

Another object is to provide an improved feeding tray for a high chair with a bowl attached thereto which prevents the bowl from spilling and slipping off the tray during meal time.

An additional object is to provide an improved feeding tray for a high chair in which the bowl is adapted to be quickly detached from the tray so that it can be properly cleaned after meal time.

A further object is to provide an improved feeding tray for a high chain that is simple and easy to use.

A still further object is to provide an improved feeding tray for a high chair that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
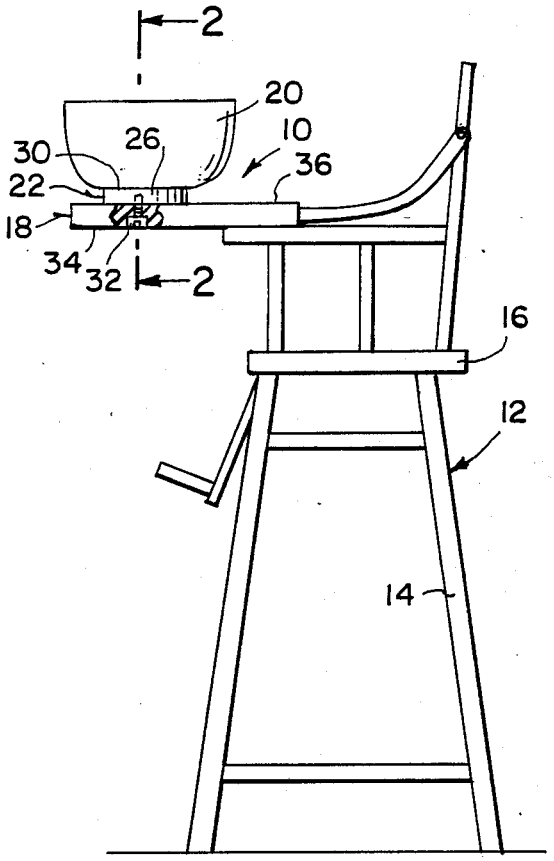
FIG. 1 is a side view of a high chair with invention installed on the tray.

Turning now descriptively to the drawings, in which similar reference characters denote similar elements throughout the several views, FIG. 1 illustrates an improved feeding tray 10 for a high chair 12 that has a supporting frame 14 and a seating structure 16 supported by the frame 14. The tray 10 contains a tray structure 18 mounted on the frame 14 in convenient relation to the seating structure 16 for use by a child thereof. A bowl 20 is adapted to receive food therein. A structure 22 is provided for detachably holding the bowl 20 to the tray structure 18 to prevent the bowl 20 from spilling and slipping off the tray structure 18 during meal time for the child.

Figure 2:
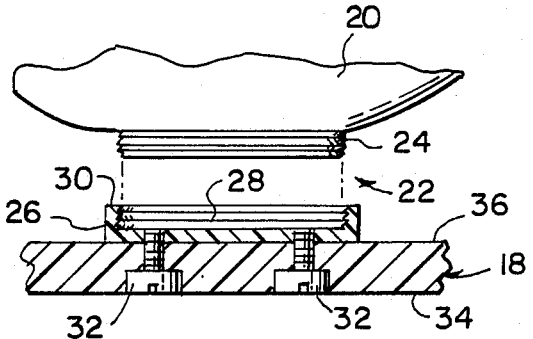
FIG. 2 is an exploded cross sectional view taken along line 2—2 in FIG. 1 showing the invention in greater detail.

As best seen in FIG. 2, the detachably holding structure 22 includes the bowl 20 having an externally threaded bottom seat 24. A base 26 has an internally threaded aperture 28 in top surface 30 thereof for receiving the threaded bottom seat 24 of the bowl 20 therein. A pair of screws 32 are mounted through underside 34 of the tray structure 18 and into the base 26 for securing the base to top surface 36 of the tray structure.

Figure 3:
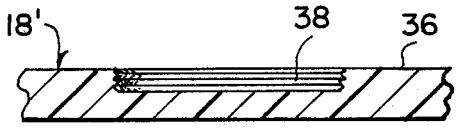
FIG. 3 is a cross sectional view of a modification taken through tray structure having an internally threaded aperture therein.

FIG. 3 shows a modified tray structure 18' having an internally threaded aperture 38 in the top surface 36 for receiving the threaded bottom seat 24 of the bowl 20 therein.

Figure 4:
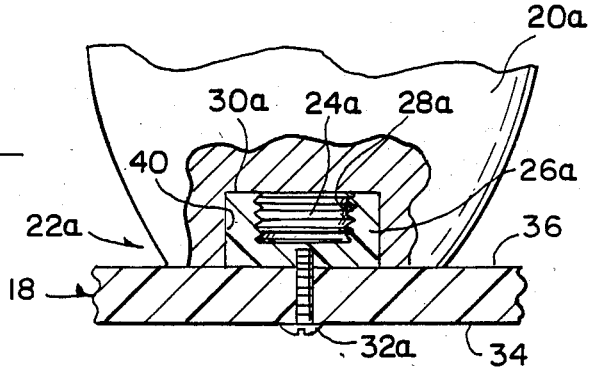
FIG. 4 is a cross sectional view showing another modification in which a threaded base on the tray structure engages with a recessed externally threaded bottom seat hidden in the bowl.

FIG. 4 shows a modified detachably holding structure **22*a* which includes the bowl 20*a* having a bottom recess 40 with an externally threaded seat 24*a* therein. A base 26*a* has an internally threaded aperture 28*a* in top surface 30*a* thereof for receiving the externally threaded seat 24*a* whereby the base 26*a* is hidden within the recess 40 of the bowl 20*a*. A screw 32*a* is mounted through underside 34 of the tray structure 18 and into the base 26*a* for securing the base to top surface 36 of the tray structure 18**.

Figure 5:
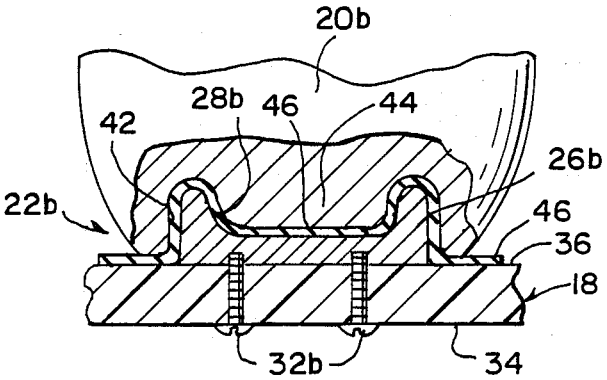
FIG. 5 is a cross sectional view showing still another modification in which the base includes a rubber suction cup to hold the bottom recess of the bowl thereto.

FIG. 5 shows another modified detachably holding structure **22*b* which includes the bowl 26*b* having a bottom recess 42 with a downward projection 44 therein. A base 26*b* has an aperture 28*b* and is conformed to fit into the bottom recess 42 with the downward projection 44 entering the aperture 28*b* so that the base 26*b* will be hidden within the bottom recess 42. A pair of screws 32*b* are mounted through underside 34 of the tray structure 18 and into the base 26*b* for securing the base to top surface 36 of the tray structure 18. A flexible suction cup 46 is disposed to extend over the base 26*b* for holding the bottom recess 42 of the bowl 20*b*** thereto.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An improved feeding tray for a high chair of the type having a supporting frame and a seating structure supported by the frame said tray comprising:

(a) a tray structure mounted on the frame in convenient relation to the seating structure for use by a child thereof;

(b) a bowl adapted to receive food therein; and (c) means for detachably holding said bowl to said tray structure to prevent the bowl from spilling and slipping off said tray structure during meal time for the child, wherein said detachably holding means includes:

(d) said bowl having a bottom-recessed with an externally threaded connector within said recess; and (e) a base secured to said tray having an internally threaded connector wherein said base is snugly received fully within said recess when said connector is fully threaded into said aperture.

2. An improved feeding tray for a high chair of the type having a supporting frame and a seating structure supported by the frame said tray comprising:

(a) a tray structure mounted on the frame in convenient relation to the seating structure for use by a child thereof;

(b) a bowl adapted to receive food therein; and (c) means for detachably holding said bowl to said tray structure to prevent the bowl from spilling and slipping off said tray structure during meal time for the child, wherein said detachably holding means includes:

(d) said bowl having a bottom recess with an inner downward projection within said recess;

(e) a base with an inner depression conformed to fit into said bottom recess with said downward projection fitting into said depression so that said base will be hidden within said bottom recess;

(f) means for securing said base to said tray structure; and (g) a flexible suction cup disposed over said base fitting between said bowl and said base in a manner whereby insertion of said bowl into said base will wedge said bowl into said base and cause conventional suction to retain said bowl in said base.

* * * * *